US006131231A

United States Patent [19]

Huang

[11] Patent Number: 6,131,231

[45] Date of Patent: Oct. 17, 2000

[54] STRUCTURE OF A BRUSH

[76] Inventor: Cheng-Ho Huang, 2 Fl., No. 4, Lane 71, Chung-Cheng N. Rd., Taipei Hsien, Taiwan

[21] Appl. No.: 09/294,550

[22] Filed: Apr. 20, 1999

[51] Int. Cl.[7] ..... A46B 5/02; A47L 23/04

[52] U.S. Cl. ..... 15/105; 15/143.1; 15/161; 16/430; 16/DIG. 12

[58] Field of Search ..... 15/105, 161, 143.1, 15/111; D4/138, 104; 16/430, DIG. 12

[56] References Cited

U.S. PATENT DOCUMENTS

| | | | |
|---|---|---|---|
| 2,021,158 | 11/1935 | Stearns . | |
| 2,633,591 | 4/1953 | Servilla | 15/143.1 |
| 2,914,785 | 12/1959 | Ela | 15/111 |
| 3,067,446 | 12/1962 | McGauley | 15/143.1 |
| 5,351,358 | 10/1994 | Larrimore | 15/143.1 |
| 5,517,713 | 5/1996 | Hadcock | 15/143.1 |

FOREIGN PATENT DOCUMENTS

| | | | |
|---|---|---|---|
| 240586 | 10/1925 | United Kingdom | 15/111 |

*Primary Examiner*—Randall E. Chin
*Attorney, Agent, or Firm*—Bacon & Thomas, PLLC

[57] ABSTRACT

A brush includes a handle extending from one side of the brush head. The handle includes protrusions formed on two ends of an upper surface of the handle and a concave portion formed between the protrusions of receiving the user's thumb. First and second spacers are formed on the lower side of the handle in such a manner that the first spacer is arranged to be held by the index and middle fingers of the user when the thumb is situated in the concave portion and the middle finger extends between the first and second spacers. A concave cambered surface on the second spacer can accommodate a third finger for optimal comfort and control of the handle.

7 Claims, 5 Drawing Sheets

STRUCTURE OF A BRUSH

FIELD OF THE INVENTION

The present invention relates to an improved structure of a brush, and especially to a structure of a brush meeting the requirement of ergonomics so as to provide comfort and tight holding. Thus, the brush can easily brush and swing upwards and downwards and be pulled and pushed.

BACKGROUND OF THE INVENTION

Brushes, for example, toothbrushes, clothes brushes, shoe brushes, etc. are used in daily life. In general, a toothbrush has a handle. The commercial toothbrush often emphasizes the brush hairs or the texture or pattern on the handle, while the comfort and feel of the brush head or brush handle is neglected. The activity is controlled by a wrist instead of fingers. The orientations of movement of the brush is confined. Often, the fingers collide with the brush head, or the brush drops down, or the hand may feel uncomfortable. All these are induced by the long handle held by hands. Further, in general, because a shoe brush has no handle, the user not only feels uncomfortable, but also the shoe polish will contact with the hand.

A special brush is a toothbrush for cleaning artificial teeth. In cleaning, the artificial teeth is taken out from the mouth, and a commercial toothbrush serves to brush the artificial teeth. Other than the aforesaid defects, since the long handle of the prior art toothbrush can not be stored in an artificial teeth box for storing artificial teeth, the brush is unsuitable to be carried with the teeth. Therefore, from the aforementioned description, it is known that an improved brush structure with a short handle and suitable to be held is eagerly demand.

SUMMARY OF THE INVENTION

Accordingly, the primary object of the present invention is to provide an improved structure of a brush, and especially, a structure of a brush meeting the requirement of ergonomics. A handle is extended from one side of the brush head of the brush. Protrusions are formed on the two ends of the upper surface of the handle and a concave portion is formed between the two protrusions. Spacers are installed in the proper position at the lower surface of the handle. In use, the thumb meets the concave portion. The index finger and middle finger hold the two sides of the spacers so as to provide comfort and tight holding. Thus, the brush can easily brush and swing upwards and downwards or be pulled or pushed.

Another object of the present invention is to provide an improved structure of a brush, wherein a spacer is extended downwards from the protrusion on the distal end of the handle and. The surface thereof is formed with a proper cambered surface. When the spacer is held, it will meet the arc of the third finger so as to provide improved holding comfort and ease-of-use.

A further object of the present invention is to provide an improved structure of a brush, wherein a groove is installed in the concave portion. When a thumb is near the concave portion, the skin of the thumb will be trapped into the groove, so as to be fixed therewithin.

A still further object of the present invention is to provide an improved structure of a brush, wherein a hole is formed on the distal end of the handle for being implanted with a tip bar for cleaning dirt in the gaps.

Yet another object of the present invention is to provide an improved structure of a brush, wherein the handle can be made with different orientations. The size of the brush head, the area of the brush hairs, and the density of the brush hairs are designed with the use of the brush.

The various objects and advantages of the present invention will be more readily understood from the following detailed description when read in conjunction with the appended drawings.

DETAILED DESCRIPTION OF THE PREFERRED EMBODIMENTS

Figure 1:
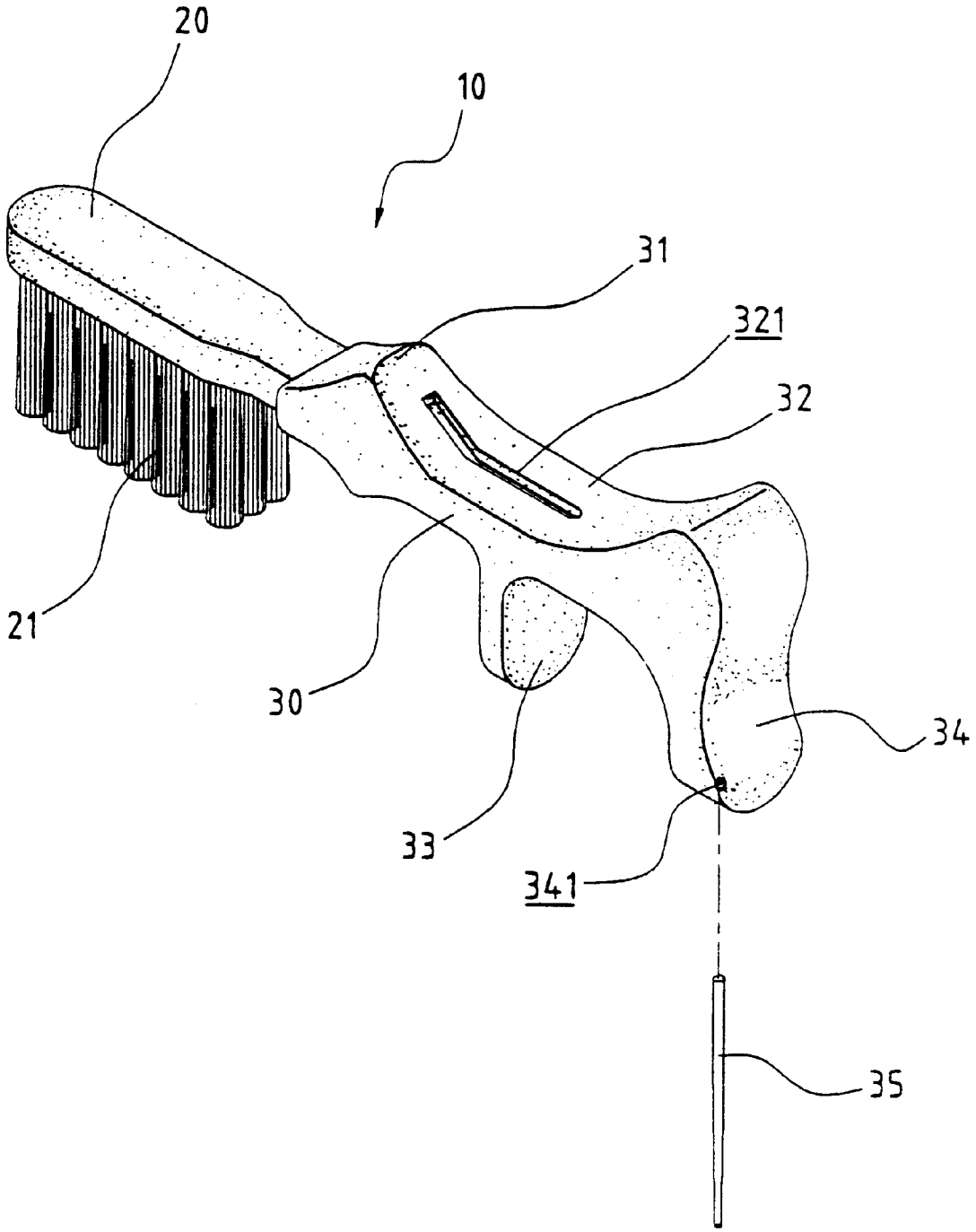
FIG. 1 is a perspective view of the present invention.

With reference to FIG. 1, the perspective view of the present invention is illustrated. The brush 10 according to the present invention is designed according to requirements of ergonomics. In particular, the design handle 30 is designed according to the arc of fingers. The brush 10 of the present invention includes a brush head 20 and a handle 30.

Figure 3:
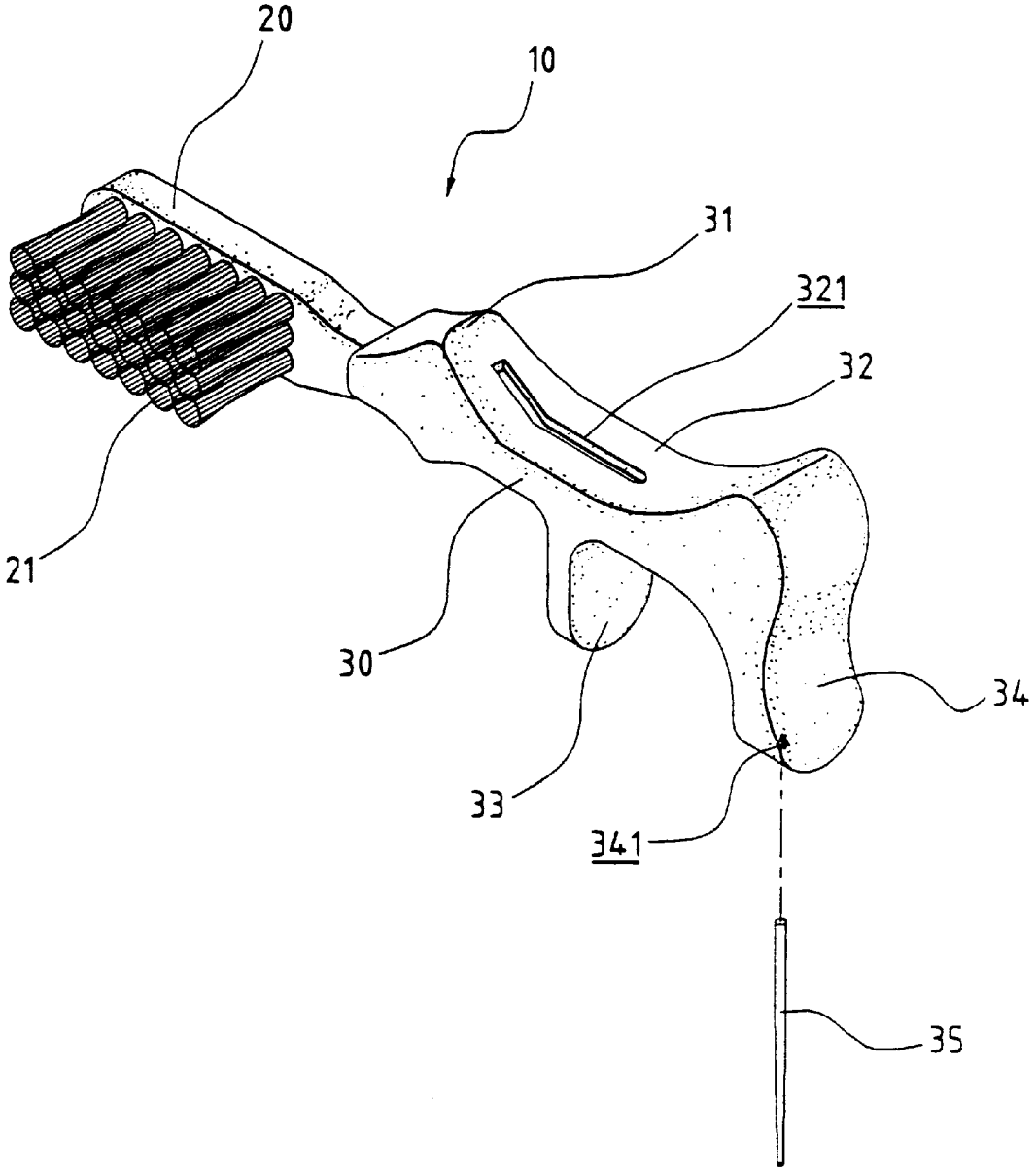
FIG. 3 shows another embodiment of the present invention.
Figure 5:
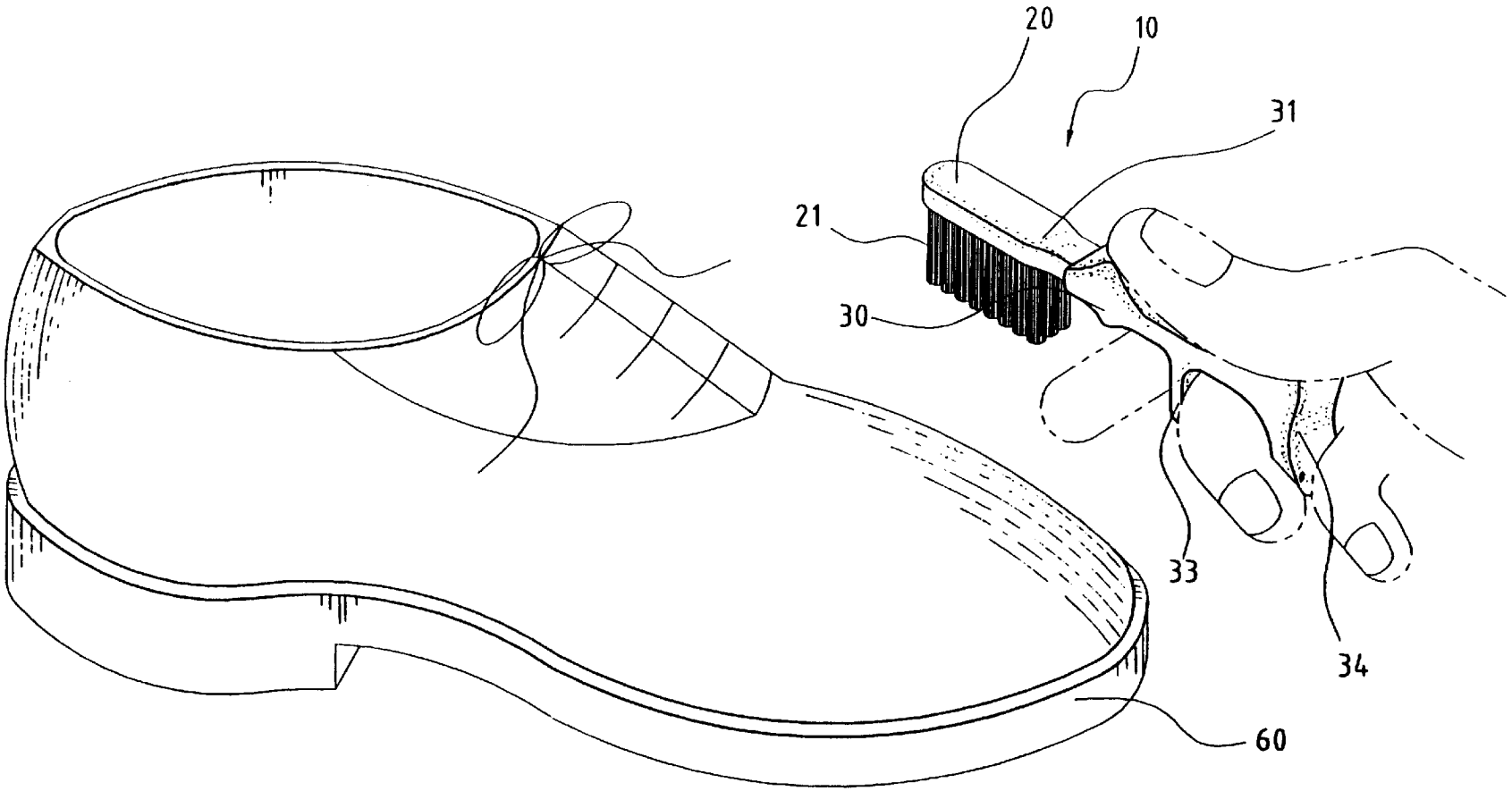
FIG. 5 shows another embodiment according to the present invention, showing that the present invention serves as a shoe brush.

The brush head 20 has a flat shape. One side of the handle 20 is implanted with brush hairs 21. The brush hairs 21 may have a flat head portion or wave shape with long and short hairs depending on the use of the brush. A handle 30 is extended from one side of the brush head 20. The brush head 20 may be a flat type. The brush hairs 21 may extend straight from the upper (or lower) side of the brush head 20. Alternatively the brush head 20 may be an upright type, wherein the brush hairs 21 are located on the left or right sides of the brush head 20 so that they have different orientations. Moreover, the size of the brush head 20, the area of the brush hairs 21 and the density of the brush hairs 21 are varied according to the use of the brush (as shown in FIGS. 3 and 5).

Two protrusions 31 are formed on the two ends of the upper side of the handle 30. A concave portion 32 has an arc meeting that of the first section of the thumb. A groove 321 is installed on the concave portion 32. When the thumb 32 is located in the concave portion 32, the skin of the thumb will be compressed into the groove 321 due to pressure so that the position of the thumb is fixed.

A protruding first spacer 33 is formed on the lower lateral surface of the handle 30, and a second spacer 34 is extended downwards from the distal end of the handle 30. The middle finger can be located between the first spacer 33 and the second spacer 34. The middle finger and index finger will hold the first spacer 33.

A concave cambered surface is formed on the surface of the second spacer 34 and meets the arc of third finger so to provide a preferred holding sense. The lower end of the second spacer 34 is installed with a hole 341 for receiving a pick member 35 so that the pick member can be stored in the hole and taken out as needed for cleaning dirt in small gaps.

Figure 2:
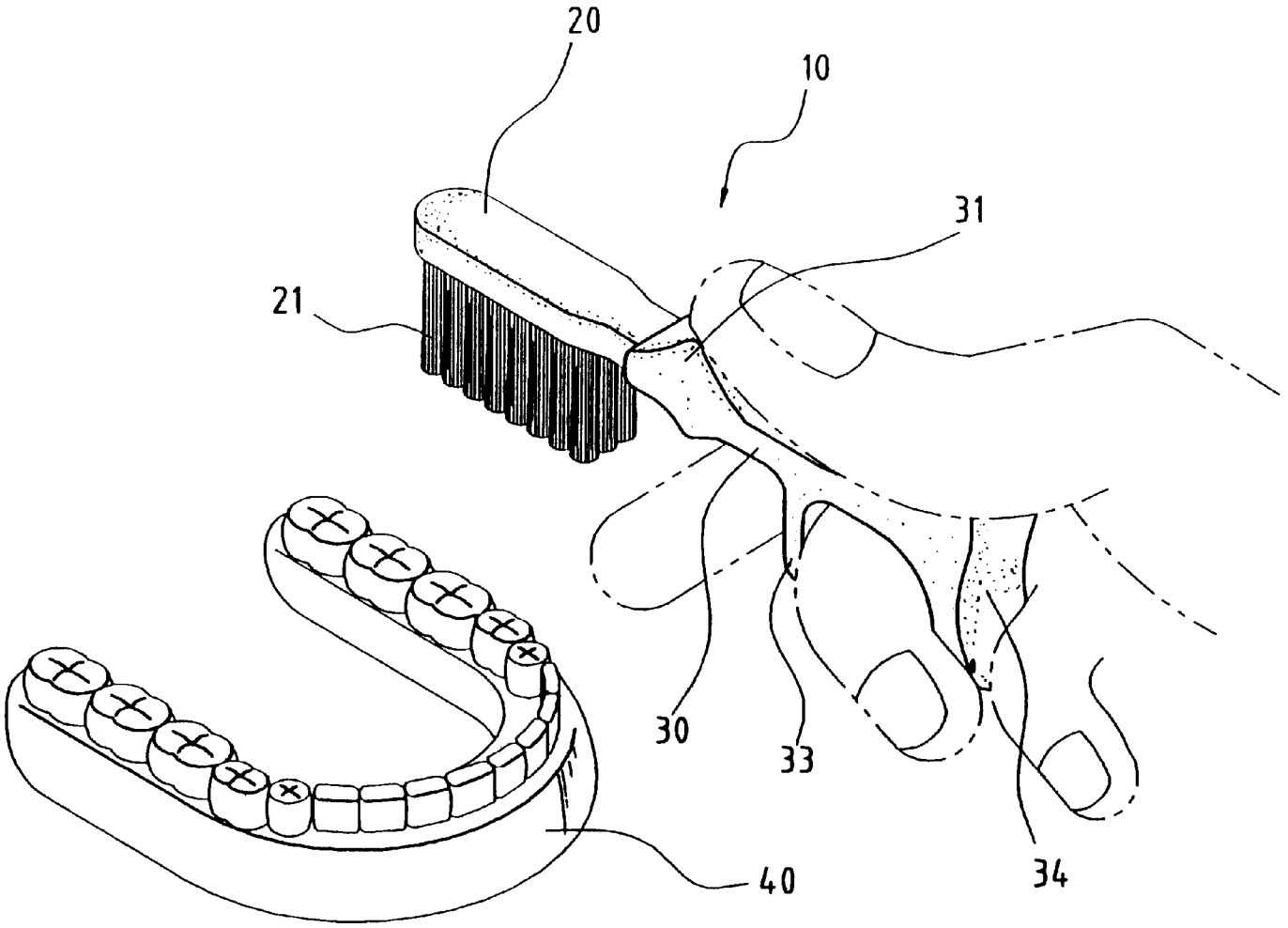
FIG. 2 shows an application of the present invention.

As shown in FIG. 2, in the present embodiment, the brush 10 is adapted for cleaning artificial teeth 40. The brush hairs 21 are implanted under the brush head 20. In use, the thumb is located near the concave portion 32. The third finger and the middle finger are located on the two sides of the first spacer 33 under the handle 30 so as to clamp the first spacer 33. The third finger adheres to the surface of the second spacer 34. Since the arc of the present invention is designed according to the arc of fingers, the fingers may hold the brush comfortably. Thus, the brush can brush and swing upwards and downwards and be pulled and pushed. Since the handle 30 is short, it can clean each portion of the artificial teeth 40 easily. The gap in each artificial teeth can be completely cleaned by a separate tooth pick member 35 stored in the second spacer 34.

Besides, since the handle is short so as to be contained within the case of artificial teeth (not shown), it is portable for cleaning artificial teeth at any location.

Figure 4:
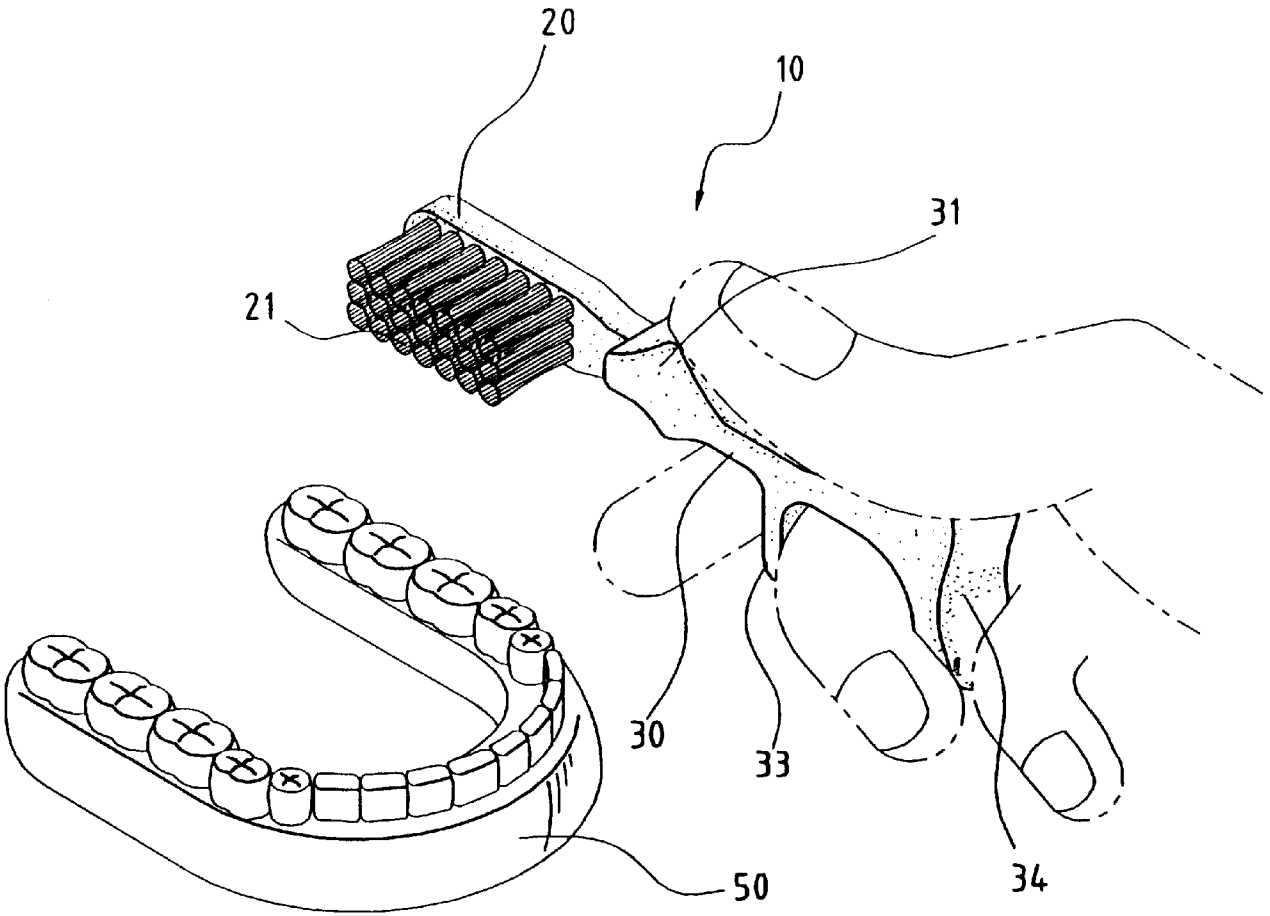
FIG. 4 shows an application of FIG. 3.

As shown in FIGS. 3 and 4, the brush head 20 stands upright and the brush hairs 21 are installed on the left side of the brush head 20. In this embodiment, the brush is adapted to be used as a tooth brush, and thus, the conventional brush with a long handle is improved. The dirt inside and outside the teeth 50 can be removed by the action of the fingers. Moreover, by the handle of the present invention designed according to the design of ergonomics, the handle can be held easily by fingers. Since the brush of the present invention has a short handle, it has a light weight, a short travelling length, may save force, and can be held tightly. This is beneficial to old people, children and patients.

Moreover, referring to FIG. 5, in another embodiment, the brush according to the present invention serves to brush shoes. The area of the brush head 20 is enlarged, and more brush hairs 21 are implanted thereon. The holding mechanism of the handle 30 is identical to that described above. In cleaning the shoe 60, the brush head 20 will not be held to prevent touching of the shoe polish.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A brush, comprising:

a brush head having a flat shape and first and second sides, the first side of the brush head being implanted with brush hairs;

a handle attached to the second side of the brush head, two protrusions being formed on two ends of an upper surface of the handle, one of said two ends being adjacent the brush head and the other of said two ends forming a distal end of the handle, and a concave portion extending between the two protrusions, said handle further including only two spacers formed on a lower lateral surface of the handle, said only two spacers including a protruding first spacer extending from the lower lateral surface of the handle at a position generally opposite said concave surface, said first spacer being arranged to be held by a first finger and a second finger, and a second spacer extending downwards from the protrusion at the distal end of the handle, said second spacer being arranged such that the first finger is located between the first spacer and the second spacer when the thumb is situated on the concave surface extending between said two protrusions.

2. A brush as claimed in claim 1, wherein the brush hairs have a flat shape.

3. A brush as claimed in claim 1, wherein an arc of the concave portion matches an arc of a first section of the thumb.

4. A brush as claimed in claim 1, wherein a groove extends into a surface of the concave portion for trapping skin of the thumb so that the thumb is fixed therewithin.

5. A brush as claimed in claim 1, wherein the handle is arranged such that the first finger located between the first spacer and the second finger when the thumb is situated on the upper surface of the handle is a middle finger and the second finger which together with the first finger holds the first spacer is an index finger.

6. A brush as claimed in claim 1, wherein the brush hairs have a wave shape with long and short brush hairs.

7. A brush, comprising:

a brush head having a flat shape and first and second sides, the first side of the brush head being implanted with brush hairs;

a handle attached to the second side of the brush head, two protrusions being formed on two ends of an upper surface of the handle, one of said two ends being adjacent the brush head and the other of said two ends forming a distal end of the handle, and a concave portion extending between the two protrusions, said handle further including only two spacers formed on a lower lateral surface of the handle, said only two spacers including a protruding first spacer extending from the lower lateral surface of the handle at a position generally opposite said concave surface, said first spacer being arranged to be held by a first finger and a second finger, and a second spacer extending downwards from the protrusion at the distal end of the handle, said second spacer being arranged such that the first finger is located between the first spacer and the second spacer when the thumb is situated on the concave surface extending between said two protrusions, wherein a concave cambered surface is formed on a surface of the second spacer such that when the first spacer is being held, a shape of the concave cambered surface matches an arc of the a third finger.

* * * * *